US009581035B2

(12) United States Patent
Macelroy

(10) Patent No.: US 9,581,035 B2
(45) Date of Patent: Feb. 28, 2017

(54) TURBINE NOZZLE COMPONENTS HAVING REDUCED FLOW AREAS

(71) Applicant: HONEYWELL INTERNATIONAL INC., Morristown, NJ (US)

(72) Inventor: Bill Macelroy, Greer, SC (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 139 days.

(21) Appl. No.: 14/810,802

(22) Filed: Jul. 28, 2015

(65) Prior Publication Data

US 2016/0010474 A1 Jan. 14, 2016

Related U.S. Application Data

(62) Division of application No. 13/364,794, filed on Feb. 2, 2012, now Pat. No. 9,121,282.

(51) Int. Cl.

| | |
|---|---|
| ***F04D 29/44*** | (2006.01) |
| ***F01D 9/04*** | (2006.01) |
| ***F01D 25/28*** | (2006.01) |

(52) U.S. Cl.

CPC ..... *F01D 9/047* (2013.01); *F01D 9/04* (2013.01); *F01D 9/041* (2013.01); *F01D 25/28* (2013.01); *F05D 2220/30* (2013.01); *F05D 2230/21* (2013.01); *F05D 2230/237* (2013.01); *F05D 2240/128* (2013.01); *F05D 2270/3061* (2013.01)

(58) Field of Classification Search

CPC . F01D 9/044; F01D 9/04; F01D 25/28; F05D 2270/3061

USPC ..... 415/189, 190, 200; 29/402.09

See application file for complete search history.

(56) References Cited

U.S. PATENT DOCUMENTS

| | | | |
|---|---|---|---|
| 4,827,588 A | 5/1989 | Meyer | |
| 4,945,630 A | 8/1990 | Gellert | |
| 6,388,223 B2 | 5/2002 | Jones et al. | |
| 6,418,618 B1 | 7/2002 | Burdgick | |
| 6,451,454 B1 | 9/2002 | Hasz et al. | |
| 6,464,128 B1 | 10/2002 | Messelling et al. | |
| 6,575,349 B2 | 6/2003 | Van Esch | |
| 6,735,936 B2 | 5/2004 | Rey et al. | |
| 6,827,254 B2 | 12/2004 | Hasz et al. | |
| 7,051,435 B1 * | 5/2006 | Subramanian | B23K 1/0018 29/402.11 |

(Continued)

OTHER PUBLICATIONS

Lord, et al.; Flow Control Opportunities in Gas Turbine Engines; AIAA 2000-2234, Fluids 2000, Jun. 19-22, 2000, Denver, CO.

(Continued)

*Primary Examiner* — Gregory Anderson
*Assistant Examiner* — Jason Fountain
(74) *Attorney, Agent, or Firm* — Lorenz & Kopf, LLP

(57) ABSTRACT

Embodiments of a method for controllably reducing of the flow area of a turbine nozzle component are provided, as are embodiments of turbine nozzle components having reduced flow areas. In one embodiment, the method includes the steps of obtaining a turbine nozzle component having a plurality of turbine nozzle flow paths therethrough, positioning braze preforms in the plurality of turbine nozzle flow paths and against a surface of the turbine nozzle component, and bonding the braze preforms to the turbine nozzle component to achieve a controlled reduction in the flow area of the turbine nozzle flow paths.

19 Claims, 4 Drawing Sheets

(56) References Cited

U.S. PATENT DOCUMENTS

| | | | | |
|---|---|---|---|---|
| 7,186,070 | B2 * | 3/2007 | Morris | F01D 5/005 29/889.22 |
| 7,331,755 | B2 * | 2/2008 | Broderick | F01D 5/288 29/889.22 |
| 7,343,676 | B2 * | 3/2008 | Ng | B23K 35/0238 228/119 |
| 7,596,940 | B2 | 10/2009 | Fint et al. | |
| 7,699,944 | B2 | 4/2010 | Hu | |
| 7,845,549 | B2 | 12/2010 | Budinger | |
| 8,047,771 | B2 | 11/2011 | Tucker et al. | |
| 8,192,152 | B2 | 6/2012 | Bunting | |
| 8,356,409 | B2 * | 1/2013 | Perret | B23K 1/0018 228/119 |
| 8,365,405 | B2 * | 2/2013 | Minor | B23P 6/005 29/402.02 |
| 2006/0219330 | A1 | 10/2006 | Hu et al. | |
| 2007/0147991 | A1 | 6/2007 | Dasilva | |
| 2010/0237134 | A1 * | 9/2010 | Bucci | B22F 7/062 228/119 |
| 2011/0180199 | A1 | 7/2011 | Huxol et al. | |

OTHER PUBLICATIONS

USPTO Office Action for U.S. Appl. No. 13/364,794 dated Aug. 1, 2014.

USPTO Office Action for U.S. Appl. No. 13/364,794 dated Feb. 12, 2015.

USPTO Notice of Allowance and Fee(s) due for U.S. Appl. No. 13/364,794 dated May 7, 2015.

* cited by examiner

TURBINE NOZZLE COMPONENTS HAVING REDUCED FLOW AREAS

CROSS-REFERENCE TO RELATED APPLICATION

This application is a divisional of co-pending U.S. application Ser. No. 13/364,794, filed Feb. 2, 2012.

TECHNICAL FIELD

The following disclosure relates generally to gas turbine engines and, more particularly, to embodiments of a method for reducing the flow areas of turbine nozzle components, as well as to embodiments of turbine nozzle components having reduced flow areas.

BACKGROUND

During operation, a gas turbine engine compresses intake air, mixes the compressed air with fuel, and ignites the fuel-air mixture to produce combustive gasses, which are then expanded through a number of air turbines to drive rotation of the turbine rotors and produce power. Turbine nozzles are commonly positioned upstream of the turbine rotors to meter combustive gas flow, while also accelerating and turning the gas flow toward the rotor blades. A turbine nozzle typically assumes the form of a generally annular structure having a number of flow passages extending axially and tangentially therethrough. By common design, the turbine nozzle includes an inner endwall or shroud, which is generally annular in shape and which is circumscribed by an outer endwall or shroud. A series of circumferentially-spaced airfoils or vanes extends between the inner and outer endwalls. Each pair of adjacent turbine nozzle vanes cooperates with the inner and outer endwalls to define a different combustive gas flow path through the turbine nozzle. When assembled from multiple, separately-cast segments, which are mechanically joined together during engine installation, the turbine nozzle is commonly referred to as a "turbine nozzle ring assembly."

The cross-sectional flow area across the turbine flow paths (referred to herein as the "turbine flow area") has a direct effect on fuel efficiency and other measures of engine performance. Turbine flow area affects exit gas temperatures and metering rates through turbine nozzle, which impact the power conversion efficiency of the turbine rotor or rotors downstream of the nozzle. It is, however, difficult to manufacture a turbine nozzle having an ideal turbine flow area in an efficient, highly-controlled, and cost-effective manner. For example, in instances wherein a number of individual turbine nozzle segments are separately cast and assembled to produce a turbine nozzle ring assembly, it is often difficult to produce nozzle segments having tightly controlled inner dimensions due to uncertainties inherent in the casting process, such as dimensional changes resulting from metal shrinkage during cooling. While it is possible to fine tune part dimensions via the production of multiple molds in a trial-and-error process, such a practice is time consuming and may incur significant expense as each investment mold may cost several hundred thousand U.S. dollars to produce. It may be possible to adjust the turbine flow area, within certain limits, by cold working the vanes after casting to further open or close the flow path metering points. This solution is, however, less than ideal and may result in undesired distortion of the nozzle vanes, as well as obstruction of any cooling channels provided downstream of the metering points. Furthermore, even if a turbine nozzle is initially produced to have an ideal or near-ideal effective flow area, gradual material loss due to hot gas erosion and/or abrasion of the nozzle vanes and endwalls during operation can result in the undesired enlargement of the turbine flow area over time, which may ultimately necessitate replacement of the turbine nozzle.

BRIEF SUMMARY

In view of the remarks set-forth in the foregoing section entitled "BACKGROUND," it would be desirable to provide embodiments of a method for reducing the effective flow area of a turbine nozzle or turbine nozzle component in a highly-controllable, reliable, efficient, and cost effective manner. Ideally, embodiments of such a method would enable newly-produced gas turbine nozzles to be initially cast or otherwise fabricated to include enlarged flow areas, which can then be subsequently fine tuned to accommodate variances in the initial fabrication process. It would also be desirable for embodiments of such a method to enable restoration of service-run turbine nozzles by returning erosion-enlarged flow areas to original dimensions at a fraction of the cost of nozzle replacement. Finally, it would also be desirable to provide embodiments of a turbine nozzle having a reduced flow area and produced pursuant to embodiments of such a method. Other desirable features and characteristics of the present invention will become apparent from the subsequent Detailed Description and the appended Claims, taken in conjunction with the accompanying Drawings and the foregoing Background.

In satisfaction of one or more of the foregoing objectives, embodiments of a method for controllably reducing the flow area of a turbine nozzle component are provided herein. In one embodiment, the method includes the steps of obtaining a turbine nozzle component having a plurality of turbine nozzle flow paths therethrough, positioning braze preforms in the plurality of turbine nozzle flow paths and against a surface of the turbine nozzle component, and bonding the braze preforms to the turbine nozzle component to achieve a controlled reduction in the flow area of the turbine nozzle flow paths.

Embodiments of a turbine nozzle component are further provided. In one embodiment, the turbine nozzle component includes an inner endwall, an outer endwall radially spaced from the inner endwall, and a plurality of nozzle vanes extending between the inner and outer endwalls. A plurality of turbine nozzle flow paths extends through the turbine nozzle and is generally defined by the inner endwall, the outer endwall, and the plurality of nozzle vanes. A plurality of braze preforms is positioned in the turbine nozzle flow paths and bonded to at least one of the inner endwall and outer endwall to reduce the flow area of the turbine nozzle flow paths.

BRIEF DESCRIPTION OF THE DRAWINGS

At least one example of the present invention will hereinafter be described in conjunction with the following figures, wherein like numerals denote like elements, and.

DETAILED DESCRIPTION

The following Detailed Description is merely exemplary in nature and is not intended to limit the invention or the application and uses of the invention. Furthermore, there is no intention to be bound by any theory presented in the preceding Background or the following Detailed Description. Terms such as "comprise," "include," "have," and variations thereof are utilized herein to denote non-exclusive inclusions. Such terms may thus be utilized in describing processes, articles, apparatuses, and the like that include one or more named steps or elements, but may further include additional unnamed steps or elements.

Figure 1:
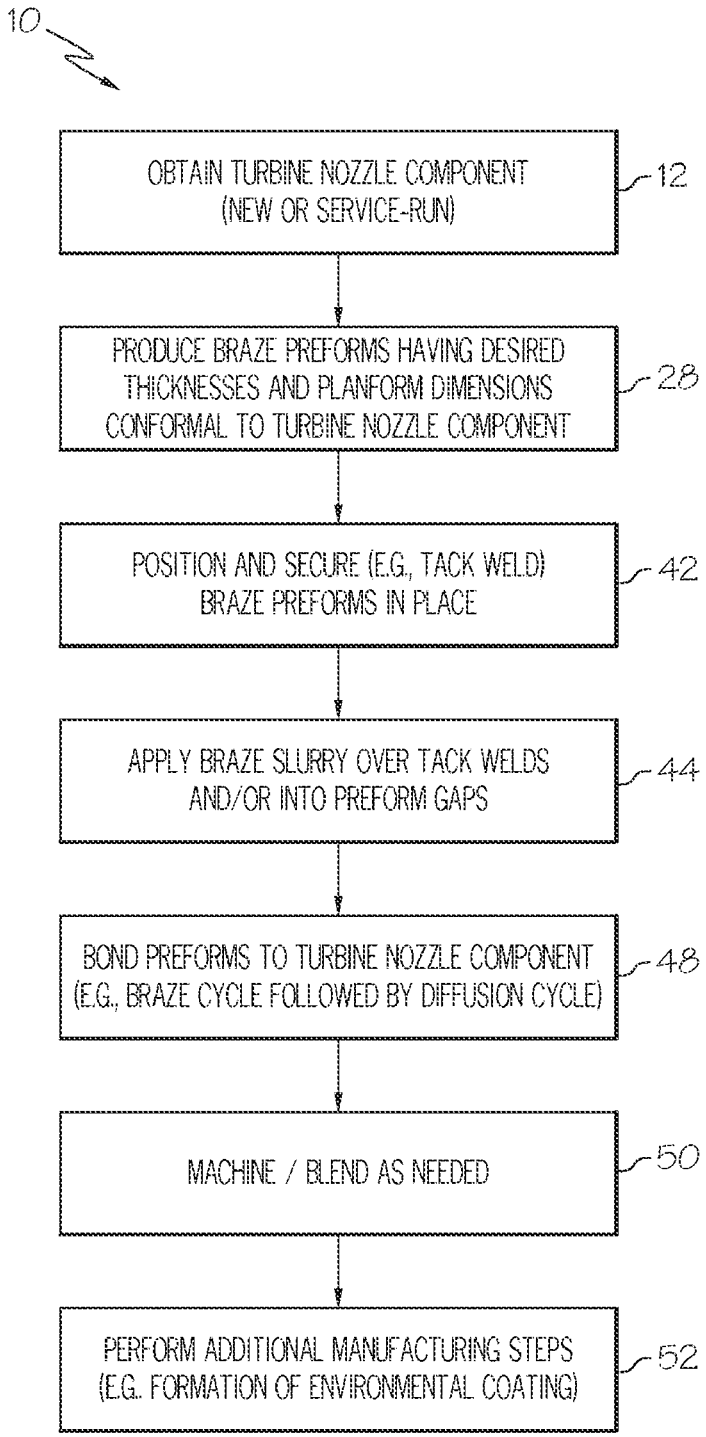
FIG. 1 is a flowchart illustrating an exemplary method for controllably reducing the effective flow area of a turbine nozzle component.

FIG. 1 is a flowchart illustrating an exemplary method 10 for reducing the effective flow area of a turbine nozzle component. The term "turbine nozzle component" is utilized herein to denote a turbine nozzle segment or other structure that can be mechanically attached to one or more additional components to produce a completed turbine nozzle assembly, such as a turbine nozzle ring assembly. The term "turbine nozzle component" is also utilized herein to encompass a monolithic or single-piece turbine nozzle, which may be produced utilizing a single shot casting process, by metallurgically bonding a number of discrete pieces to produce a consolidated monolithic structure, or by another fabrication method. Regardless of whether the turbine nozzle component is comprised of a single monolithic structure or assembled from multiple discrete components, the turbine nozzle component is fabricated to include a number of combustive gas flow paths therethrough. Embodiments of method 10 can be carried-out to reduce the effective flow area through the turbine nozzle flow paths in a controlled, reliable, and cost-effective manner. Thus, as a non-limiting example, method 10 can be employed to fine tune the effective flow area of a newly-cast turbine nozzle component to compensate for variations in the casting process that may otherwise be difficult to control or predict. Additionally, method 10 can be utilized to restore service-run turbine nozzles to original dimensions (or other target dimensions) after undesired enlargement of the turbine nozzle flow due to hot gas erosion, abrasion, or the like. The steps illustrated in FIG. 1 and described below are provided by way of example only; in alternative embodiments of method 10, additional steps may be performed, certain steps may be omitted, and/or steps may be performed in alternative sequences.

Figure 2:
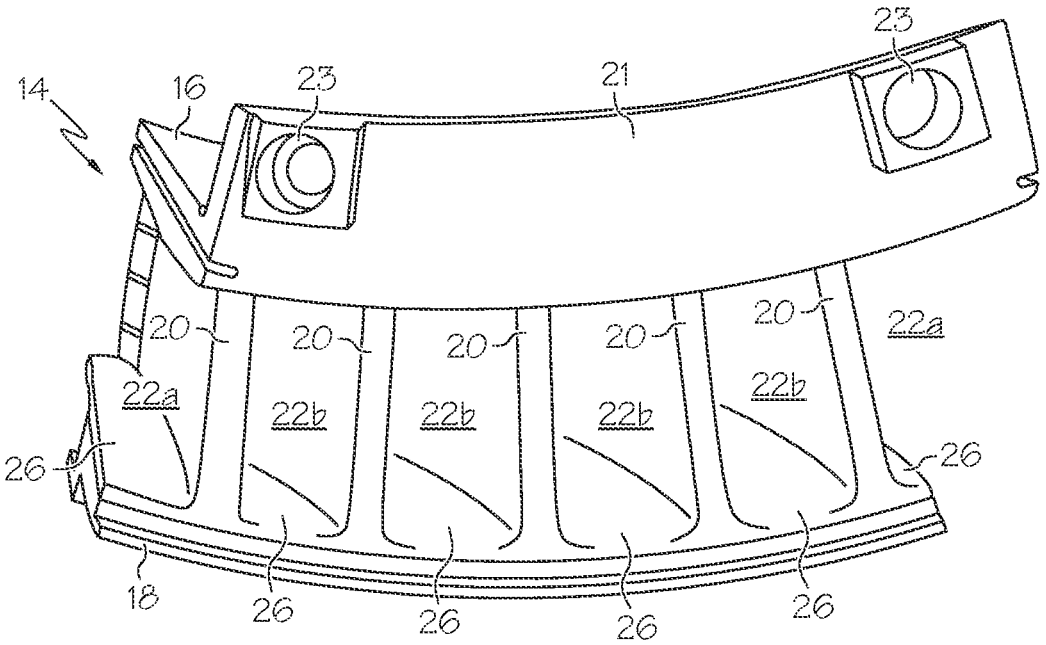
FIGS. 2 and 3 are isometric and cross-sectional views, respectively, of an exemplary turbine nozzle component that may be obtained pursuant to the exemplary method shown in FIG. 1.
Figure 3:
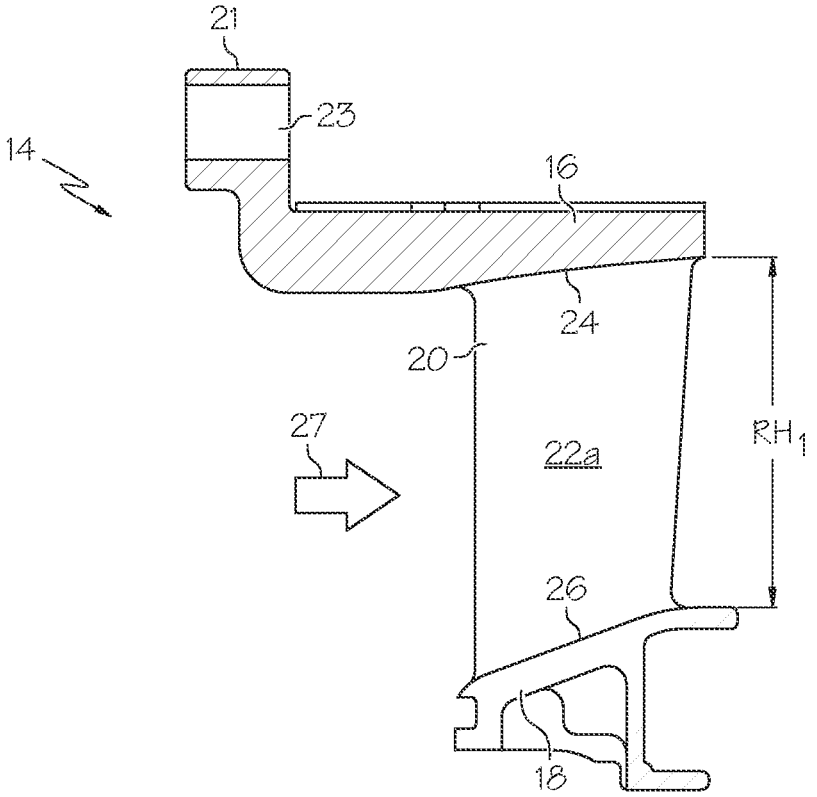

Method 10 commences with the provision of a turbine nozzle component (STEP 12, FIG. 1). The turbine nozzle component may be a newly-manufactured component or a fielded component recovered from a service-run gas turbine engine. FIGS. 2 and 3 are isometric and cross-sectional views, respectively, of an exemplary turbine nozzle component 14 that may be obtained pursuant to STEP 12 of exemplary method 10 (FIG. 1). In the illustrated example, turbine nozzle component 14 is a turbine nozzle segment including an inner shroud or endwall 16, an outer shroud or endwall 18, and a plurality of airfoils or vanes 20. Inner endwall 16 and outer endwall 18 are spaced apart in a radial direction and each have a substantially arc-shaped geometry. When installed within a gas turbine engine, turbine nozzle component 14 is joined to a number of like turbine nozzle components to produce a turbine nozzle ring assembly. The dimensions and curvature of inner and outer endwall 16 and 18 are generally determined by the characteristics of the host gas turbine engine and by the number of segments included within the assembly; e.g., in the illustrated example, inner endwall 16 and outer endwall 18 may each span an arc of approximately 32.7°, and eleven turbine nozzle segments may be assembled to complete the turbine nozzle ring assembly. Regardless of its particular position within the turbine nozzle ring assembly, turbine nozzle component 14 is oriented such that inner endwall 16 resides closer to the longitudinal axis of the ring assembly and to the engine centerline than does outer endwall 18. As further indicated in FIGS. 2 and 3, inner endwall 16 may be fabricated to include a flange 21 having a number of fastener openings 23 through which a plurality of bolts or other such fasteners may be disposed to facilitate attachment to the other nozzle components and/or to the engine infrastructure (not shown).

Nozzle vanes 20 extend radially between inner endwall 16 and outer endwall 18 to define a number of combustive gas flow paths 22 through the body of turbine nozzle component 14. Each gas flow path 22 is defined by a different pair of adjacent or neighboring vanes 20; an interior surface region of inner endwall 16 located between the neighboring vanes 20, as taken in a radial direction; and an interior surface region of outer endwall 18 located between the neighboring vanes 20, as taken in a radial direction. The interior surface regions of inner endwall 16 bounding gas flow paths 22 are referred to herein as the "inner inter-blade flow areas," one of which is identified in FIG. 3 by reference numeral 24. Similarly, the interior surface regions of outer endwall 18 bounding gas flow paths 22 are referred to herein as the "outer inter-blade flow areas" and identified in FIGS. 2 and 3 by reference numerals 26. Gas flow paths 22 extend through turbine nozzle component 14 in axial and tangential directions to guide combustive gas flow through the body of component 14, while turning the gas flow toward the blades of a turbine rotor (not shown) positioned immediately downstream of component 14. In the illustrated example wherein turbine nozzle component 14 includes a total of five vanes 20, vanes 20 cooperate with endwalls 16 and 18 to define four fully-enclosed flow paths 22(*a*) and two partially-enclosed flow paths 22(*b*) (shown in FIG. 2). Partially-enclosed flow paths 22(*b*) (FIG. 2) are fully enclosed when turbine nozzle component 14 is positioned between like turbine nozzle components during turbine nozzle assembly.

As may be appreciated most easily by referring to FIG. 3, gas flow paths 22 constrict or decrease in cross-sectional flow area when moving in a fore-aft direction along which combustive gas flows during engine operation (represented in FIG. 3 by arrow 27). Each flow path 22 thus serves as a convergent nozzle to meter and accelerate combustive gas flow through the turbine nozzle. The most restricted flow area along each flow path 22, or "vane metering point," has a predetermined lateral width determined by the lateral vane-to-vane spacing and an initial radial height (represented in FIG. 3 by doubled-headed arrow $RH_1$) determined by the radial distance between inner endwall 16 and outer endwall 18. As will be described more fully below, at least one braze preform is positioned within each turbine flow path 22 and bonded to inner endwall 16 and/or outer endwall 18 to decrease the radial height of the vane metering point and thereby decrease the total cross-sectional flow area through turbine nozzle component 14.

In the exemplary embodiment shown in FIGS. 2 and 3, turbine nozzle component 14 is produced as a single-piece or monolithic structure utilizing, for example, a single pour casting process and a lost wax mold having a skin formed from ceramic or other high temperature material. Inner endwall 16, outer endwall 18, and nozzle vanes 20 are thus integrally formed such that the opposing longitudinal edges of nozzle vanes 20 contact and are directly adjoined to endwalls 16 and 18. This example notwithstanding, turbine nozzle component 14 can be assembled from multiple discrete parts in alternative embodiments or produced by the consolidation of multiple discrete parts, which are metallurgically bonded to yield a monolithic structure. Turbine nozzle component 14 is advantageously formed from a material (or materials) having relatively high mechanical strength and chemical (e.g., oxidation and corrosion) resistance at high temperatures. Suitable materials include, but are not limited, high temperature superalloys, structural ceramics, silicon nitride-based materials, and silicon-carbide based materials. In a preferred embodiment, turbine nozzle component 14 is cast from a cobalt-based or nickel-based superalloy. A thermal barrier system and/or an environmental coating (e.g., a corrosion-resistant aluminide coating) may be formed over the entirety or selected portions of turbine nozzle component 14 after initial fabrication thereof.

As noted above, turbine nozzle component 14 may be a newly-manufactured component or a service-run component requiring restoration to original dimensions (or other target dimensions) due to structural erosion along turbine nozzle flow paths 22. In embodiments wherein turbine nozzle component 14 is recovered from a service-run engine, additional processing may be performed during STEP 12 (FIG. 1) to prepare component 14 for subsequent bonding of the braze preforms (described below). For example, if an environmental coating (e.g., a corrosion-resistant aluminide coating) has been deposited or otherwise formed over the exterior of component 14, the environmental coating may be chemically stripped. Fluorescent penetrant inspection or another non-destructive inspection technique may then be performed to detect any cracks and other structural defects along turbine flow paths 22 or other regions of components 14. Any detected structural defects materially detracting from the structural integrity of component 14 may be repaired. For example, any detected cracks may be healed by application and thermal processing of a braze slurry. The braze slurry may have a formulation similar to that of the turbine nozzle parent material, but further including one or more additional metallic components decreasing the slurry melt point to enable the slurry to flow into the cracks by capillary forces during thermal cycling and heal the cracks upon solidification. Finally, one or more cleaning steps may be performed to remove contaminants from the surface of component 14; e.g., a hydrogen fluoride ion clean may be performed to remove deeply embedded oxides from component 14 followed by a vacuum clean process.

Exemplary method 10 continues with the production of a number of braze preforms specific to turbine nozzle component 14 (STEP 28, FIG. 1) As utilized herein, the term "produced" encompasses independent fabrication of the braze preforms, as well as purchase of the preforms from a third party supplier. The braze preforms are specific to turbine nozzle component in the sense that the thickness of the braze preforms is selected based upon the desired reduction in turbine nozzle flow area and the preform geometry is tailored to the inner geometries of turbine nozzle component 14, as taken along flow paths 22. The braze preforms are produced to have geometries enabling each preform to be inserted between neighboring vanes 20 and against inner endwall 16 and/or outer endwall 18 in a close fitting relationship. In a preferred embodiment, each braze preform is preferably fabricated to have a geometry substantially conformal with the space located between two neighboring vanes 20 and adjacent endwall 16 or endwall 18. Stated differently, each braze preform is preferably fabricated such that at least a portion of the braze preform has an outer contour or planform shape (i.e., a geometry viewed along an axis orthogonal to either major face of the preform) substantially conformal with one of inner inter-blade flow areas 24 (FIG. 3) or one of outer inter-blade flow area 26 (FIGS. 2 and 3) bounding the particular flow path 22 into which the braze preform is to be inserted.

The braze preforms can be fabricated from various high temperature materials capable of forming a strong metallurgical bond with turbine nozzle component 14 and, specifically, with inner endwall 16 and/or outer endwall 18 during thermal cycling. Generally, it is desirable for the braze preforms to have high temperature properties similar to those of the turbine nozzle parent material to minimize disparities in material behavior (e.g., thermal expansion and contraction) within a high temperature gas turbine engine environment and thereby promote durability and enhance the component's serviceable lifespan. For this reason, in embodiments wherein turbine nozzle component 14 is fabricated (e.g., cast) from a master superalloy, the braze preform material may be formulated from the master superalloy mixed with one or more additional metallic or non-metallic constituents added in powder form to the master alloy during processing. The additional constituents include at least one melt point suppressant, which decreases the material melt point to enable brazing to turbine nozzle component 14 at a temperature below the softening point of the base superalloy. Additional metallic or non-metallic constituents may also be added to the master alloy to optimize desired metallurgical properties of the braze preforms, such as oxidation and corrosion resistance. In certain embodiments, boron may be further added to the master alloy to increase penetration of the preform material into the parent material during any subsequently-performed diffusion step, as described below in conjunction with STEP 48 of exemplary method 10 (FIG. 1). In a preferred embodiment, the braze preforms consists substantially entirely of metallic components and are substantially free (i.e., contain less than 1 wt. %) of non-metallic components, such as ceramics.

Various different fabrication processes may be utilized to fabricate the braze preforms from the selected braze material. This notwithstanding, the braze preforms are advantageously formed from multiple layers of braze tape, which are laid in successive layers to achieve a desired thickness, cut to a desired shape encompassing the desired geometry of the finished braze preform, and sintered to produce the finished preform. To initially fabricated the braze tape, the selected braze preform material, while in a powdered state, may be mixed with chemical binder in a predetermined proportion; e.g., the binder may make-up about 1% to about 3%, by weight ("wt. %") of the braze tape material. In one embodiment, a binder solution is employed that comprises a phosphate/chromate solution containing approximately 30 wt. % phosphate and approximately 60 wt. % chromate. In another embodiment, commercially-available chemical binder is utilized, such as the chemical binder commercially identified as "B215." The braze preform material is then formed into generally flat and elongated shape, such as a relatively thin strip or sheet. Individual pieces of braze tape may then be cut to an approximate shape utilizing a mechanical or non-mechanical cutting means, such as a waterjet. After cutting, the layered tape may be sintered to form a hardened part having a geometry generally matching the shape of one of inner inter-blade flow areas 24 (FIG. 3) and/or one of outer inter-blade flow areas 26 (FIGS. 2 and 3). To refine the shape of the layered braze tape, sintering may be carried-out while the layered pieces of braze tape are supported by a specialized forming tool or die, which may be produced by sectioning a turbine nozzle component substantially identical to turbine nozzle component 14. In one embodiment, the sintering process entails exposing the layered pieces of braze tape to temperatures exceeding the braze tape melt point (e.g., approaching or exceeding about 1400° F.) for a time period of about 60 minutes. After sintering, the edges of the preforms may be broken (e.g., rounded) to minimize interference with the nozzle segment vane fillet radii; i.e., the outwardly-curved base regions of turbine nozzle vanes 20 shown most clearly in FIG. 2.

The thickness of the braze preforms is determined as a function of the desired reduction in effective flow area across turbine nozzle flow paths 22 and, specifically, across the constricted metering points of flow paths 22. In certain embodiments, the desired reduction in turbine flow area may be established by first measuring the dimensions of turbine nozzle component 14 along flow paths 22 and then calculating the braze preform thickness required to build the inner walls of component 14 to predetermined or target dimensions. It is generally preferred, however, that airflow testing is utilized to determine the desired reduction in turbine flow area. For example, airflow testing of turbine nozzle component 14 may be carried-out utilizing a flow bench and conventional testing techniques; and the resulting data may be utilized to calculate the desired reduction in turbine flow area and, therefore, the preform thickness required to achieve the desired reduction in turbine flow area. Notably, in embodiments wherein the braze preforms are formed by sintering a number of layers of braze tape, as previously described, shrinkage and thinning of the braze tape will typically occur during the sintering due, at least in part, to decomposition of the binder material. In such cases, it is advantageous to first estimate the amount of braze tape shrinkage expected to occur during sintering, and then to account for such shrinkage in determining the thickness to which the layers of braze tape are compiled. For example, if it is determined that the braze preforms should each have a thickness of about 0.046 inch (about 0.1168 centimeter) after sintering, and a 20% reduction in axial thickness is anticipated through sintering, the braze tape may be layered to a thickness of about 0.056 inch (about 0.1422 centimeter).

Figure 4:
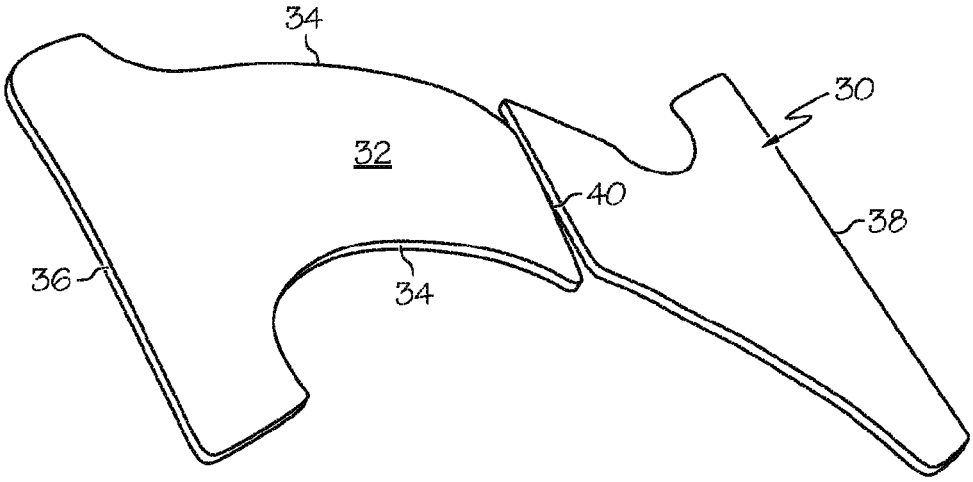
FIG. 4 is an isometric view of an exemplary braze preform that may be produced pursuant to the exemplary method shown in FIG. 1.

FIG. 4 illustrated an exemplary braze preform 30 that may be produced pursuant to STEP 28 of method 10 (FIG. 1). Braze preform 30 includes an axially-elongated body 32 having opposing sidewalls 34, which follow contour or outline approximating the facing sidewalls of neighboring nozzle vanes 20 (FIGS. 2 and 3) to enable preform 30 to be matingly inserted within a gas flow path 22 as briefly described above and as described in more detail below. Body 32 is advantageously fabricated to have a slight curvature or arc-shape to match that of the particular endwall against which preform 30 is to be positioned. In the illustrated exemplary embodiment, braze preform 30 is also fabricated to include a leading or forward portion 36 having an increased lateral width as compared to intermediate body 32 and the lateral vane-to-vane spacing. Similarly, braze preform 30 is also fabricated to include a trailing or aft portion 38 having an increased lateral width as compared to intermediate body 32 and the lateral vane-to-vane spacing. Widened preform portions 36 and 38 wrap around the leading trailing edges of nozzle vanes 20 (FIGS. 2 and 3) when braze preform 30 is properly positioned within a flow path 22 of turbine nozzle component 14 to retain braze preform 30 in place and to help create an aerodynamically streamlined surface for guiding combustive gas flow. If necessary, and as indicated in FIG. 4 by mid-line break 40, braze preform 30 can be cut, fractured, or otherwise split into two or more pieces to facilitate insertion into turbine nozzle paths 26 of turbine nozzle component 14.

After production, the braze preforms are positioned in turbine nozzle flow paths 22 and against a surface of turbine nozzle component 14 (STEP 42, FIG. 1). In embodiments wherein the braze preforms are bonded exclusively to inner endwall 16, the braze preforms may be positioned against inner endwall 16 and between turbine nozzle vanes 20 such that each braze preform covers or overlays at least a portion, and preferably the entirety, of different inner inter-blade flow area 24 (FIG. 3). Conversely, in embodiments wherein the braze preforms are bonded exclusively to outer endwall 18, the braze preforms may be positioned against outer endwall 18 and between turbine nozzle vanes 20 such that each braze preform covers or overlays at least a portion, and preferably the entirety of, a different outer inter-blade flow area 26 (FIGS. 2 and 3). Finally, in embodiments wherein the braze preforms are bonded to both inner endwall 16 and outer endwall 18, the braze preforms may be positioned in both of the previously-described manners.

Figure 5:
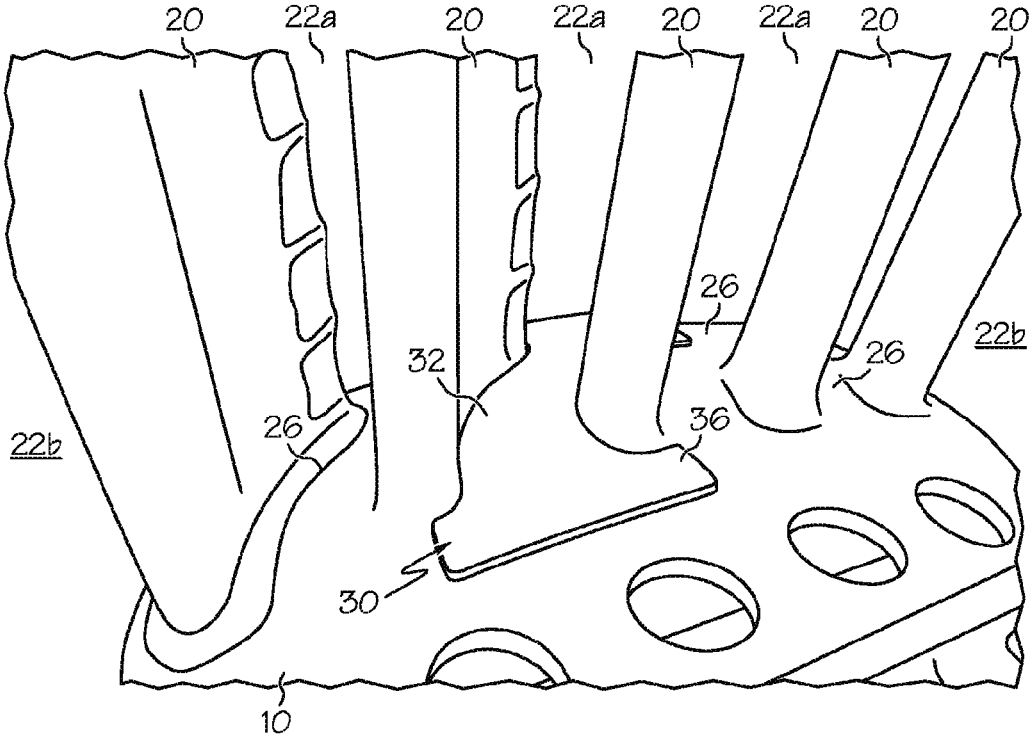
FIG. 5 is an isometric view illustrating one manner in which the exemplary braze preform shown in FIG. 4 may be positioned within a turbine nozzle flow path and, specifically, over the surface region of an endwall located between adjacent nozzle vanes to reduce the cross-sectional flow area across the turbine nozzle flow path.

The geometry of the braze preforms will vary depending upon whether the preform is positioned in a fully-enclosed flow path 22(*a*) or in a partially-enclosed flow path 22(*b*) (FIG. 2), and whether the preform is positioned against inner endwall 16 or outer endwall 18; e.g., with reference to orientation illustrated in FIG. 2, the preform inserted into the leftmost partially-enclosed flow path 22(*a*) and against inner endwall 16 will have a first unique geometry, the preform inserted into the rightmost partially-enclosed flow path 22(*a*) and against inner endwall 16 will have a second unique geometry, the preforms inserted into each of the fully-enclosed flow paths 22(*b*) and against inner endwall 16 will each have a third unique geometry, the preforms inserted into each of the fully-enclosed flow paths 22(*b*) and against outer endwall 18 will each have a fourth unique geometry, and so on. FIG. 5 illustrates one manner in which exemplary braze preform 30 may be positioned within one of flow paths 22(*a*), over outer endwall 18, and between two neighboring nozzle vanes 20. After positioning within turbine nozzle component 14, the braze preforms are advantageously secured in place by tack welding or other resistance welding to turbine nozzle component 14; however, in further embodiments, the braze preforms may be held in place utilizing other means (e.g., a specialized fixture) or simply by gravitational forces.

Figure 6:
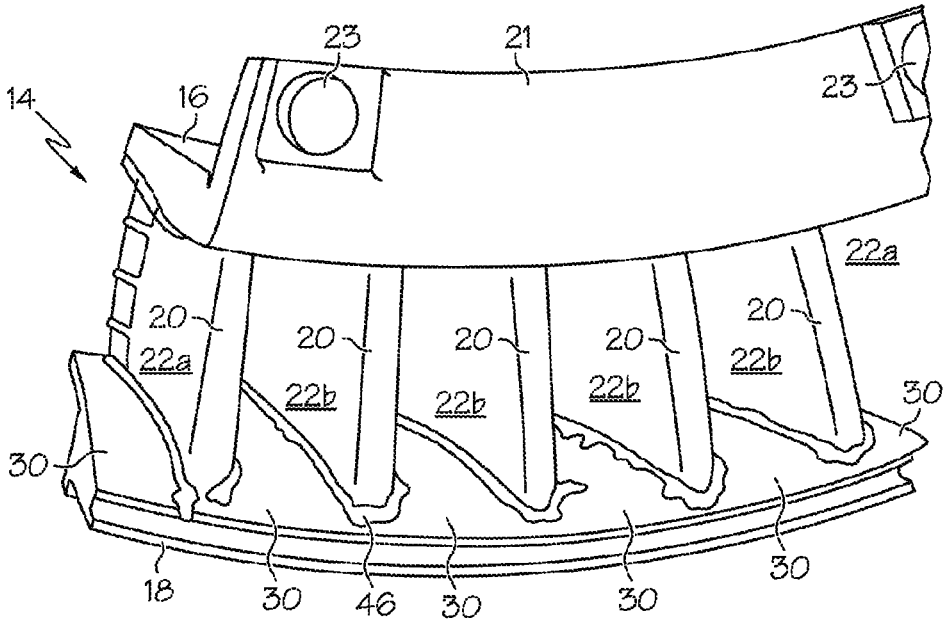
FIG. 6 is an isometric view illustrating the turbine nozzle component after tack welding of the braze preforms and application of a braze preform slurry.

In embodiments wherein the braze preforms are resistance welded to turbine nozzle component 14, a brazable gap fill material is advantageously applied any recesses, depression, or other surface imperfections created by resistance welds prior to thermal cycling to maintain the aerodynamic contours of gas flow paths 22 (STEP 44, FIG. 1). Any large gaps, spaces, or mismatches between outer circumferences of the braze preforms and interior structure of turbine nozzle component 14 may also be filled with the brazable gap fill material during STEP 44 to minimize subsequent blending requirements. A gap fill slurry may be utilized to during STEP 44 for this purpose and formulated from the selected braze preform material and a dilutant, such as isopropanol or other alcohol. The dilutant may be added to the braze preform material, in powder form, to create a flowable slurry having a desired viscosity and suitable for application via brushing, spraying, injection, or the like. The slurry may be milled, mixed, or blended to obtain a desired range of particle sizes and/or a uniform consistency. In one embodiment, the gap fill slurry is loaded into a syringe and then manually injected over the tack welds and into the preform gaps during STEP 44 (FIG. 1). FIG. 6 is an isometric view of turbine nozzle component 14 after the application of a gap fill slurry 46 over tack welds and into intervening gaps formed between the braze preforms, vanes 20, and endwalls 16 and 18.

Turbine nozzle component 14 and the braze preforms are next subject to a heat treatment process to bond the braze preforms to turbine nozzle component 14 (STEP 48, FIG. 1). The heat treatment steps and the parameters (e.g., duration, temperature, and environment) of each heat treatment step will vary amongst different embodiments of method 10 depending, at least in part, upon the dimensions and composition of the braze preforms. Heat treatment will typically include at least one thermal processing step wherein the braze preforms are heated to a first elevated temperature exceeding the preform melt point to bond the braze preforms to turbine nozzle component 14. A diffusion step may also be preformed after the initial brazing step wherein turbine nozzle component 14 and braze preforms 30 are heated to a second, lower temperature for a longer time period to promote diffusion of the braze preform material into the parent nozzle material. By way of non-limiting example, the braze and diffusion cycle may entail initial heating to an equalization temperature of about 1800±15° Farenheit for a time period of about 10 to about 15 minutes; heating to a braze temperature of about 2200±15° Fahrenheit for a time period of about 25 to about 30 minutes; a cooling period wherein the temperature is decreased to about 1850° Fahrenheit for a time period sufficient to allow accurate temperature reading; and a prolonged diffusion step wherein 2100±15° Fahrenheit for about a time period of about 350 to about 370 minutes. Brazing is preferably performed under partial vacuum conditions to prevent oxidation that could otherwise interfere with the bonding process. An inert gas, such as hydrogen, may be pumped into the braze furnace prior to brazing to achieve a desired partial pressure. In certain embodiments, a curing step may be performed prior to the above-described brazing process wherein the turbine nozzle component and braze preforms heated to a relatively low temperature (e.g., approximately 95° C.) for a predetermined time period (e.g., 2-4 hours) to evaporate the dilutent from the braze slurry.

After the braze preforms are bonded to turbine nozzle component 14 in the above-described manner (STEP 48, FIG. 1), one or more machining steps may be performed (STEP 50, FIG. 1). During STEP 50 (FIG. 1), the braze preforms and adjoining regions of turbine nozzle component 14 may be mechanically ground, polished, or otherwise smoothed to provide an aerodynamically-streamlined part. In one embodiment, any raised material remaining after the above-described bonding process may be manually smoothed or "hand blended" utilizing an abrasive tool. Machining may also be performed to remove small amounts of excess material from the now-bonded braze preforms, if necessary, to further refine the cross-sectional flow area of the turbine nozzle flow paths. In embodiments wherein the turbine nozzle component is service-run component requiring repair, machining may be performed to restore the repaired areas to their original dimensions and contours. More specifically, the inner and outer endwalls at the aft side top rails may also be machined during STEP 50 (FIG. 1) to restore nozzle segment height and qualify the surface finish. Finally, the inner and outer shroud may also be machined along their forward edges to generate radii on the shrouds tangent to the vane leading edge radii. Excess material may be removed by deburring.

Figure 7:
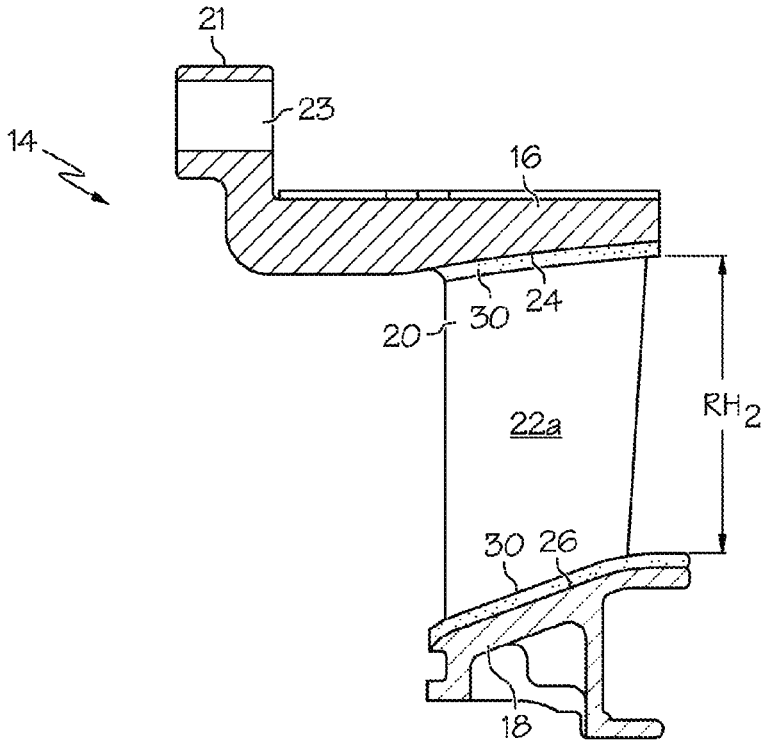
FIG. 7 is a cross-sectional view of the finished turbine nozzle component after bonding of the braze preforms, as illustrated in accordance with an exemplary embodiment of the present invention.

To complete exemplary method 10, additional manufacturing steps may be performed to finish production or restoration of the turbine nozzle component (STEP 52, FIG. 1). For example, one or more cleaning steps may be carried-out after which component 14 may be inspected for cracks or other structural defects utilizing a fluorescent penetrant inspection or other non-destructive inspection technique. An environment coating or system coating may be applied (or, if previously stripped, re-applied) at this juncture in the fabrication process; e.g., a corrosion-resistant aluminide coating may be reapplied utilizing a pack cementation process. Finally, the finished turbine nozzle component may be airflow tested to ensure that the desired reduction in turbine nozzle flow area has been achieved. An example of the manner in which turbine nozzle component 14 may appear after bonding of braze preforms 30 and subsequent machining is illustrated in cross-section in FIG. 7. As indicated in FIG. 7 by doubled-headed arrow $RH_2$, bonding of braze preforms 30 to the interior of component 14 has reduced radial height of turbine nozzle flow paths 22 to achieve a controlled reduction in the overall cross-sectional flow area of turbine nozzle component 14 and, specifically, in flow area of the flow path metering points. While braze preforms 30 are bonded to both inner endwall 16 and outer endwall 18 in FIG. 7 for the purposes of illustration, it will be appreciated that braze preforms 30 need be bonded to one of inner wall 16 or outer endwall 18 in alternative embodiments. Notably, bonding of braze preforms 30 to inner endwall 16 and/or outer endwall 18 in this manner avoids undesired distortion of turbine nozzle vanes 20 thereby preserving the performance characteristics of turbine nozzle component. In addition, braze preforms 30 to inner endwall 16 and/or outer endwall 18 minimize or eliminates any obstructions any cooling flow passages (e.g., cooling slots in the vane sidewalls) downstream of vane metering points that might otherwise be caused by cold working of the turbine vanes.

The foregoing has thus provided embodiments of a method for reducing the effective flow area of a turbine nozzle or turbine nozzle component in a controlled, reliable, efficient, and cost effective manner. Embodiments of the above-described method are advantageously employed to enable newly-produced gas turbine nozzles to be initially cast or otherwise fabricated to include enlarged flow areas, which are then subsequently fine tuned to accommodate variances in the initial fabrication process. Embodiments of the above-described method can also be utilized to restore service-run turbine nozzles by returning erosion-enlarged flow areas to original dimensions at a fraction of the cost of nozzle replacement. The foregoing has also provided embodiments of a turbine nozzle having a reduced flow area and produced pursuant to embodiments of such a method.

While at least one exemplary embodiment has been presented in the foregoing Detailed Description, it should be appreciated that a vast number of variations exist. It should also be appreciated that the exemplary embodiment or exemplary embodiments are only examples, and are not intended to limit the scope, applicability, or configuration of the invention in any way. Rather, the foregoing Detailed Description will provide those skilled in the art with a convenient road map for implementing an exemplary embodiment of the invention. It being understood that various changes may be made in the function and arrangement of elements described in an exemplary embodiment without departing from the scope of the invention as set-forth in the appended Claims.

What is claimed is:

1. A turbine nozzle component, comprising:

an inner endwall;

an outer endwall radially spaced from the inner endwall;

a plurality of nozzle vanes extending between the inner and outer endwalls, the plurality of nozzle vanes having leading and trailing edges;

a plurality of turbine nozzle flow paths extending through the turbine nozzle component and generally defined by the inner endwall, the outer endwall, and the plurality of nozzle vanes; and braze preforms positioned in the turbine nozzle flow paths and bonded to at least one of the inner endwall and outer endwall reducing the flow area of the turbine nozzle flow paths, the braze preforms wrapping around the leading and trailing edges of the plurality of nozzle vanes;

wherein at least one of the braze preforms comprises a midline break dividing the braze preform into multiple pieces, which are bonded to one of the inner endwall and the outer endwall.

2. The turbine nozzle component of claim 1 wherein the braze preforms are further welded to at least one of the inner endwall and outer endwall.

3. The turbine nozzle component of claim 1 further comprising inner inter-blade flow areas provided on the inner endwall and bounding the plurality of flow paths, the plurality of braze preforms having planform geometries substantially conformal with the inner inter-blade flow areas.

4. The turbine nozzle component of claim 1 further comprising outer inter-blade flow areas provided on the outer endwall and bounding the plurality of flow paths, the plurality of braze preforms having planform geometries substantially conformal with the outer inter-blade flow areas.

5. The turbine nozzle component of claim 1 wherein the braze preforms are interspersed with the plurality of nozzle vanes.

6. The turbine nozzle component of claim 1 wherein the turbine nozzle component is produced from a parent superalloy, and wherein the plurality of braze preforms are each composed of a braze preform material comprising the parent superalloy and at least one melt point suppressant.

7. The turbine nozzle component of claim 6 wherein the braze preform material is substantially free of non-metallic components.

8. The turbine nozzle component of claim 1 wherein the braze preforms each comprise opposing sidewalls, which follow the contour of facing sidewalls of the plurality of nozzle vanes.

9. A turbine nozzle component, comprising:

a first endwall;

a second endwall radially spaced from the first endwall;

nozzle vanes extending between the first and second endwalls;

turbine nozzle flow paths extending through the turbine nozzle component and generally defined by the first endwall, the second endwall, and the nozzle vanes;

inter-blade flow areas provided on the first endwall between the nozzle vanes and partially bounding the turbine nozzle flow paths; and braze preforms bonded to the first endwall to reduce the flow area of the turbine nozzle flow paths, the braze preforms having planform geometries substantially conformal with the inter-blade flow areas and each comprising:

an axially-elongated body; and a leading portion having an increased lateral width as compared to the axially-elongated body, the leading portion wrapping around a leading edge of at least one of the nozzle vanes.

10. The turbine nozzle component of claim 9 wherein the first endwall, the second endwall, and the turbine nozzle vanes are cast as a single piece from a master superalloy.

11. The turbine nozzle component of claim 10 wherein the braze preforms are composed of a braze preform material comprising the master alloy and a melt point suppressant.

12. The turbine nozzle component of claim 10 wherein the braze preforms are composed of a braze preform material comprising the master alloy and boron.

13. The turbine nozzle component of claim 9 wherein the braze preforms are composed of multiple layers of sintered braze tape.

14. The turbine nozzle component of claim 9 wherein the braze preforms each further comprise:

a trailing portion having an increased lateral width as compared to the axially-elongated body, the trailing portion wrapping around a trailing edge of at least one of the nozzle vanes.

15. The turbine nozzle component of claim 9 wherein the braze preforms are resistance welded to the first endwall.

16. A turbine nozzle component, comprising:

a cast body, comprising:

a first endwall;

a second endwall radially spaced from the first endwall; and nozzle vanes extending between the first and second endwalls, the nozzle vanes have a vane-to-vane spacing;

turbine nozzle flow paths extending through the cast body and each including a vane metering point having a radial height; and a first plurality of braze preforms positioned within the turbine nozzle flow paths, bonded to the first endwall, and decreasing the radial heights of the vane metering points;

wherein the first plurality of braze preforms each comprise:

a curved body; and at least one widened portion extending from the curved body and having a lateral width exceeding the vane-to-vane spacing.

17. The turbine nozzle component of claim 16 further comprising inter-blade flow areas provided on the first endwall between the nozzle vanes and covered, at least in substantial part, by the braze preforms.

18. The turbine nozzle component of claim 16 further comprising a second plurality of braze preforms positioned within the turbine nozzle flow paths, bonded to the second endwall, and further decreasing the radial heights of the vane metering points.

19. The turbine nozzle component of claim 16 wherein the curved body of each of the first plurality of braze preforms comprises opposing sidewalls, which follow the contour of facing sidewalls of the nozzle vanes.

* * * * *